US007641603B2

(12) United States Patent
Lacher

(10) Patent No.: US 7,641,603 B2
(45) Date of Patent: Jan. 5, 2010

(54) STRETCHING DEVICE

(75) Inventor: Mark Lacher, Whitestone, NY (US)

(73) Assignee: Natural Fitness, Inc., Whitestone, NY (US)

( * ) Notice: Subject to any disclaimer, the term of this patent is extended or adjusted under 35 U.S.C. 154(b) by 0 days.

(21) Appl. No.: 12/194,737

(22) Filed: Aug. 20, 2008

(65) Prior Publication Data

US 2009/0298655 A1 Dec. 3, 2009

Related U.S. Application Data

(60) Provisional application No. 61/056,476, filed on May 28, 2008.

(51) Int. Cl.
*A63B 21/00* (2006.01)

(52) U.S. Cl. ..... 482/134

(58) Field of Classification Search ..... 482/51, 482/70, 71, 131, 134, 147, 72
See application file for complete search history.

(56) References Cited

U.S. PATENT DOCUMENTS

| | | | | |
|---|---|---|---|---|
| 430,808 | A * | 6/1890 | Naish | 482/132 |
| 4,506,884 | A | 3/1985 | Hankin | |
| 4,960,276 | A * | 10/1990 | Feuer et al. | 482/70 |
| 5,147,266 | A | 9/1992 | Ricard | |
| 5,181,894 | A | 1/1993 | Shieng | |
| 5,209,711 | A | 5/1993 | Scrima | |
| 5,295,935 | A | 3/1994 | Wang | |
| 5,941,800 | A | 8/1999 | Laconis | |
| 6,368,254 | B1 | 4/2002 | Wall | |
| 6,514,180 | B1 | 2/2003 | Rawls | |
| 6,837,838 | B2 | 1/2005 | List | |
| 7,294,100 | B2 | 11/2007 | Bull | |

* cited by examiner

*Primary Examiner*—Loan H Thanh
*Assistant Examiner*—Shila Abyaneh
(74) *Attorney, Agent, or Firm*—Gottlieb, Rackman & Reisman

(57) ABSTRACT

The present invention pertains to an exercising apparatus comprising a coupling mechanism and a synchronizing mechanism. The coupling mechanism is a rack assembly that includes two elongated bars extending longitudinally within the deck of the apparatus. The elongated bars receive a vertical arm of a platform when inserted through longitudinal slots of the deck. Each end of the elongated bar terminate with a wheel for rolling on a respective trough. The elongated bars further including vertical teeth disposed on the inner surface of each elongated bar for engaging the synchronizing mechanism. A pinion assembly includes a central wheel that rotates about a vertical axis. The external teeth of the central wheel are thereafter meshed with the vertical teeth of the elongated bars to provide synchronous movement as the elongated bars reciprocate.

20 Claims, 12 Drawing Sheets

FIG. 6
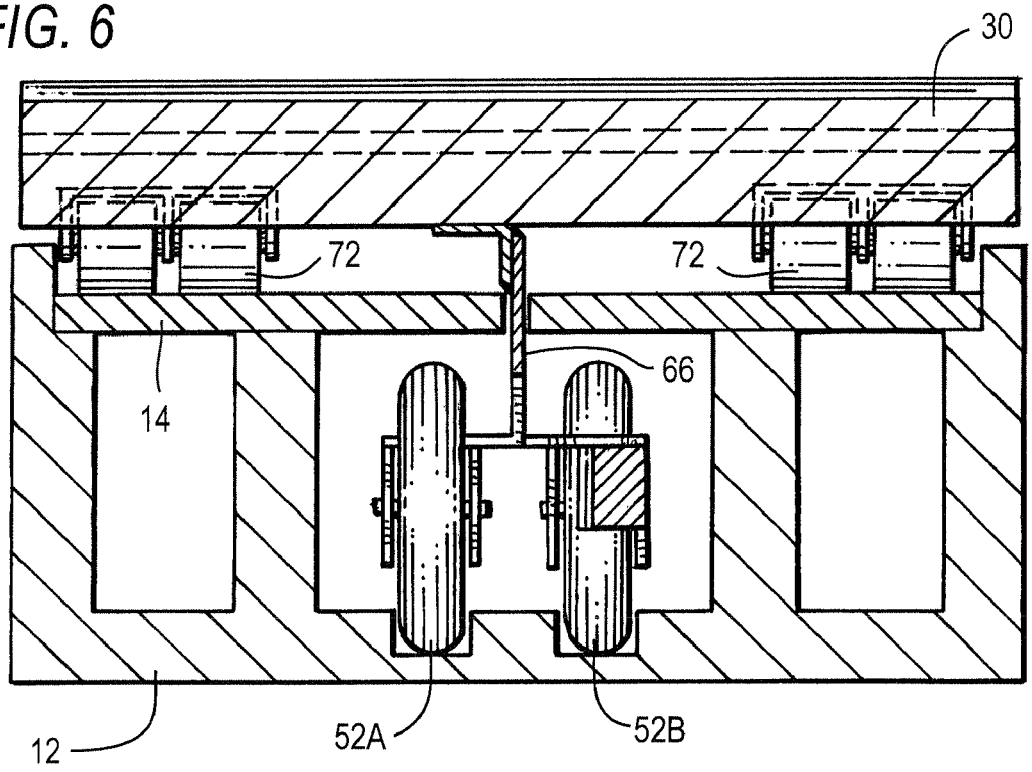
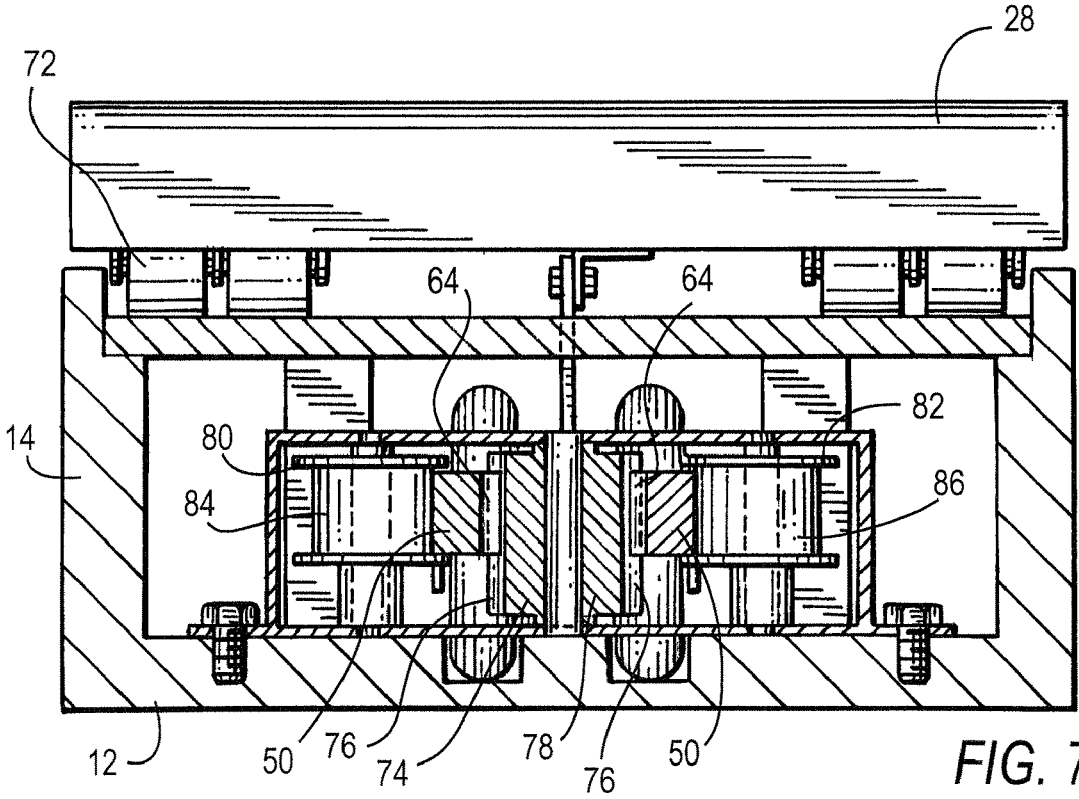
FIG. 7

FIG. 10
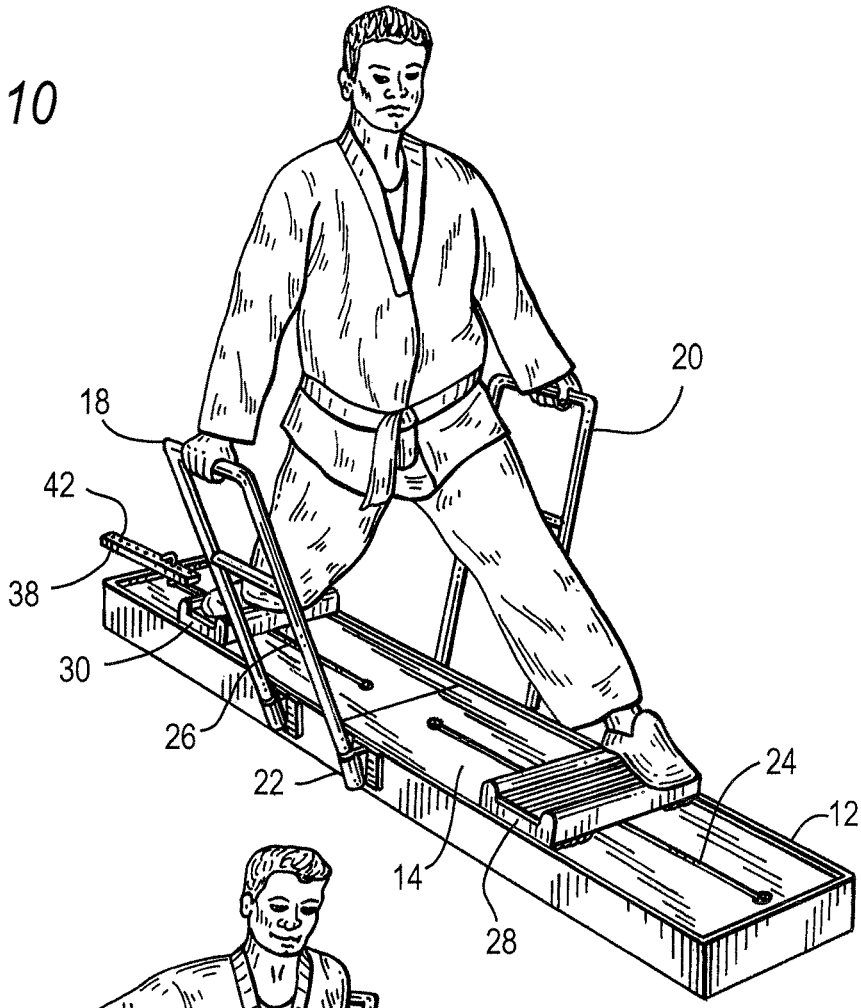
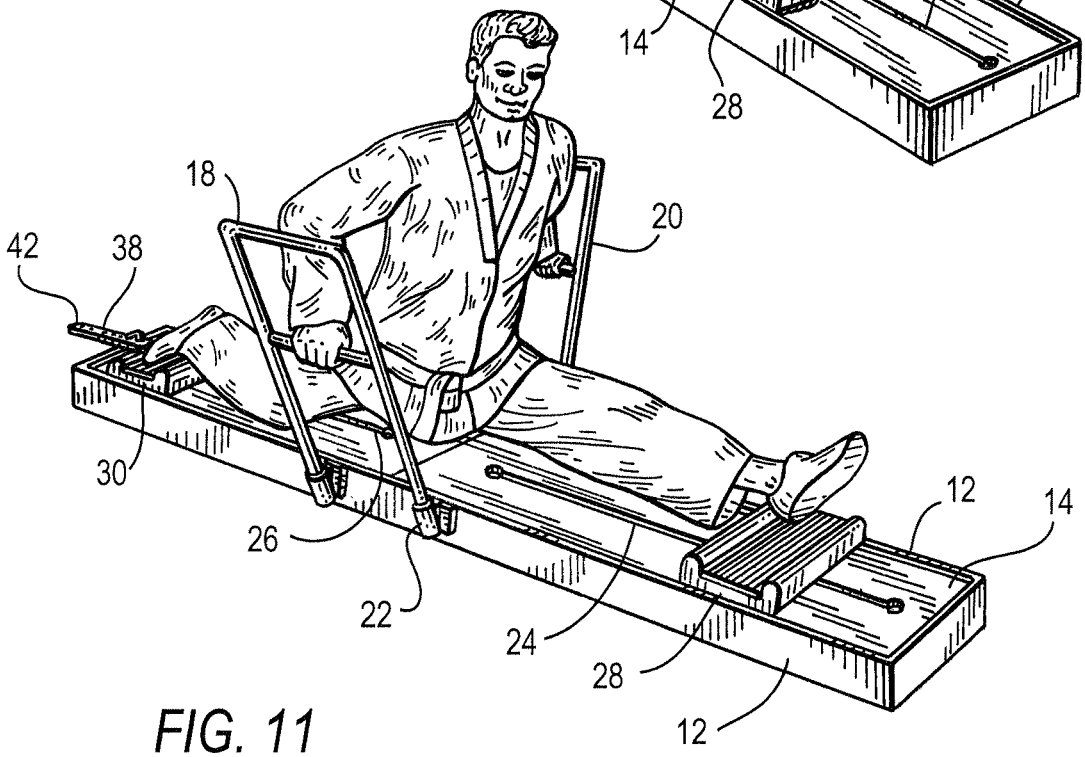
FIG. 11

STRETCHING DEVICE

RELATED APPLICATION

This application claims priority to U.S. Provisional application Ser. No. 61/056,476 filed on May 28, 2008 and incorporated herein by reference in its entirety.

BACKGROUND OF THE INVENTION

A. Field of Invention

This invention pertains to an exercising device used for stretching and other similar exercises and it includes a deck with two sliding platforms accommodating the feet of the exercising person. A synchronizing mechanism below the deck is used to couple the two platforms and insures that the two platforms move in reciprocating motion.

B. Description of the Prior Art

Many recent medical studies have shown that in today's somewhat static society there is a need for everybody to perform physical exercise for improved physical and mental health. Many devices are available for this purpose that can be used at home, in a gym, in a hotel, and so on. One such type of device is a so-called stretching device that can be used for stretching the limbs. A typical exercise on the device consists of standing on the device and stretching the feet with one foot extending forward and the other backward, or one foot stretching to the left and the other to the right. Preferably the device consists of a platform with tracks and two carriages riding on the tracks. In at least some of the devices, the carriages are interconnected so that moving one causes the other to move as well.

A problem with existing stretching devices is that they are rather complicated and as a result can be unreliable.

SUMMARY OF THE INVENTION

Briefly, the present invention pertains to an exercising machine having platforms moving on a deck and a synchronizing mechanism that is housed within the deck for synchronizing the reciprocating movement of the platforms.

The synchronizing mechanism of the present invention is a rack assembly that includes a first and second elongated bar that extends longitudinally within the deck. The deck of the exercising apparatus has a top surface with two parallel slots in which a vertical arm of each platform is slidably engaged with the parallel slots and coupled to the rack assembly.

Additionally, for a smoother motion, each elongated bar has a first and second respective end that terminates with a guide wheel. The guide wheels are thereafter guided by a first and second trough of the deck as the guide wheels ride on their respective deck as the elongated bars reciprocate.

Preferably, each of the first and second elongated are provided with a plurality of inner teeth that are disposed on the inner surface of the elongated bars. A pinion assembly is also provided that includes a central wheel that rotates about a vertical axis within the deck. The central wheel has a plurality of external teeth that are disposed circumferentially about the central wheel and are meshed with the teeth of the elongated bars.

In the above configuration, the elongated bars are coupled to the vertical arms of a platform. When the elongated bars reciprocate, the meshing of the inner and external teeth will provide a simultaneous movement of the first and second platform. For example, as the first platform moves in one direction, the second platform will simultaneously move in the opposite direction.

Moreover, the exercising apparatus includes side wheels that have a cylindrical surface for engaging the outer surface of the first and second elongated bars. The side wheels are provided to ensure that the inner teeth of the elongated bars are meshed with the external teeth of the central wheel of the pinion assembly.

In an alternative embodiment, and for providing a different exercise, a hoop is attached to the platform and a pulley is attached to one end of the deck. In this modification, one end of a rope is coupled to the hoop and is wrapped around the pulley and further terminates with a handle. In this configuration, an exercising person can do exercises similar to sit-ups. Additionally, the platform in this modification can be replaced or covered by a seat with a back-supporting member having a snapping member that is securely snapped onto the platform. Alternatively, the entire platform can be replaced or covered by a cushioned seat.

In another alternative embodiment, the top surface of the deck has a plurality of angled holes that are spaced longitudinally. The base of a foot rest includes angled inserts that extend downwards and are further able to be inserted into the plurality of angled holes.

DESCRIPTION OF THE DRAWINGS

FIG. 6 shows a sectional view of the device taken along line 6-6 in FIG. 3.

FIG. 7 shows a sectional view of the device taken along line 7-7 in FIG. 3.

FIGS. 10 and 11 show a person using the subject device to perform a front split.

DETAILED DESCRIPTION OF THE INVENTION

Figure 1:
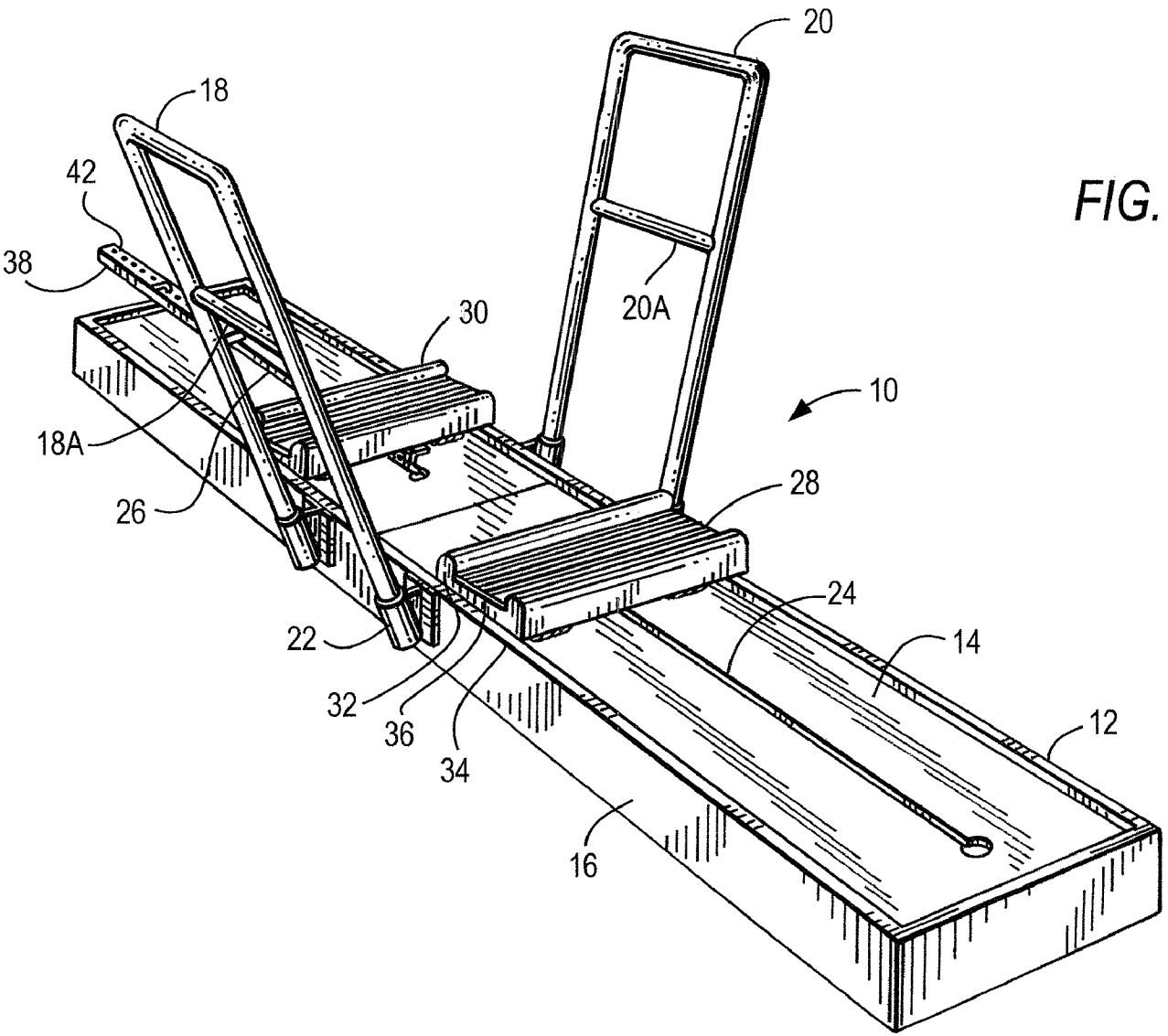
FIG. 1 shows an orthogonal view of the stretching device constructed in accordance with this invention.
Figure 2:
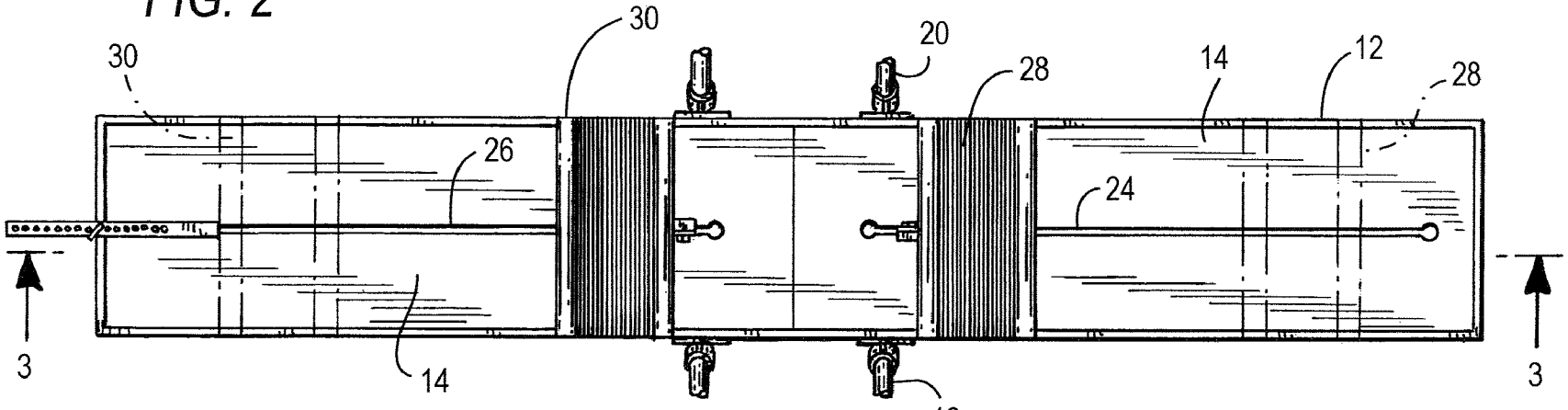
FIG. 2 shows plan view of the device of FIG. 1.
Figure 3:
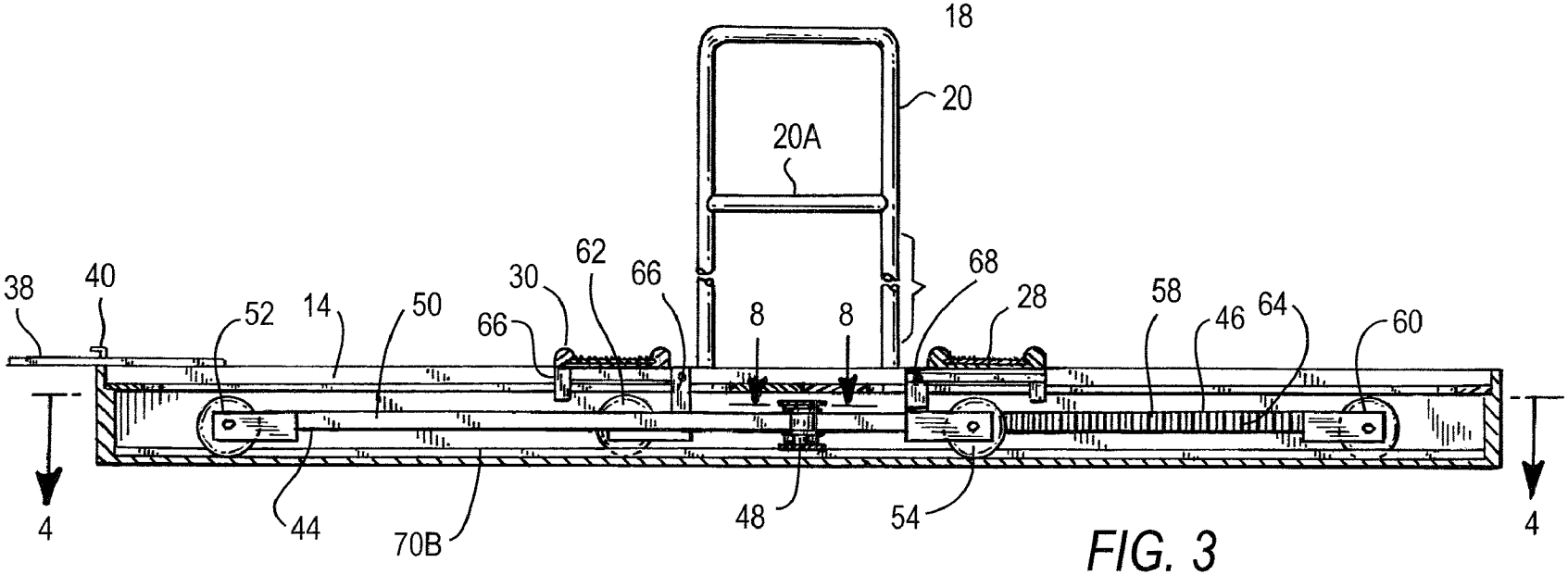
FIG. 3 shows a longitudinal sectional view of the device taken along line 3-3 in FIG. 2.
Figure 4:
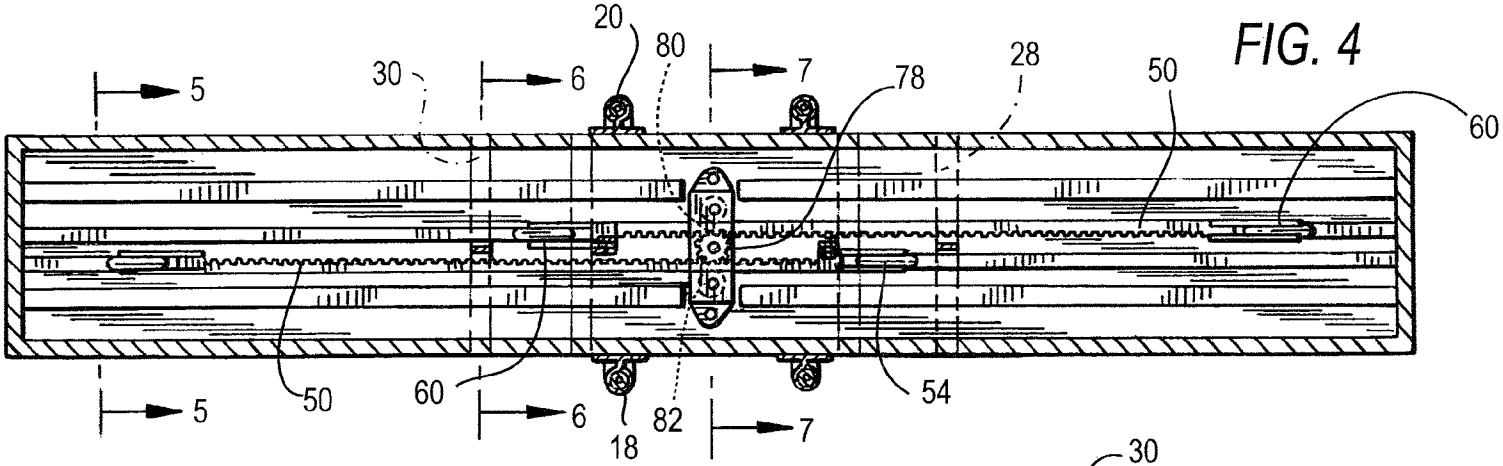
FIG. 4 shows a top sectional view of the device taken along line 4-4 in FIG. 3.

Referring now to the Figures, FIGS. 1-13 shows a device 10 formed of a deck 12 made of wood, metal, plastic or any other suitable material. The deck 12 must be strong enough to support an exercising adult. The deck 12 has a top surface 14 and two longitudinal side 16. Two handle bars 18, 20 are attached to the sides as shown. The handle bars may be permanently affixed to the deck 12, or can be mounted in sockets 22 so that they can be removed at will. The handle bars 18, 20 may be removed to store the device or to allow a person other types of exercises. Each handle bar has a respective cross-piece 18A, 20A disposed at an intermediate position.

The top surface 14 is formed with two longitudinal slots 24, 26. The slots 24, 26 hold respective platforms 28, 30. The platforms can slide along the top surface 14 in a direction parallel to their slots. Preferably, each platform has two transversal ridges 32, 34 with a flat zone 36 disposed therebetween. The platforms are sized and shaped to accept one of the feet of an exercising person, respectively, as described in more detail below.

At least at one end, the deck 12 is provided with a stop 38 in the shape of an extended bar that is attached to the deck 12 by a pin 40. The bar is formed with a plurality of holes 42. The position of the bar can be adjusted by removing the pin 40 shifting the bar and then reattaching the pin through a different hole 42. The stop 38 limits the direction of travel in the longitudinal direction. Generally the position of the bar 38 is adjusted so that the platforms 28, 30 travel more for a taller person then a short one.

The platform 12 is preferably hollow and houses a mechanism coupling and synchronizing the movements of the platforms 28, 30. More particularly, the mechanical coupling includes two rack assemblies 44, 46 and a pinion assembly 48. Rack assembly 44 includes an elongated bar 50 extending longitudinally through the deck 12 and terminating with two wheels 52, 54. Rack assembly 46 has the same elements as rack assembly 44, e.g., a bar 58, and two wheels 60, 62.

Figure 5:
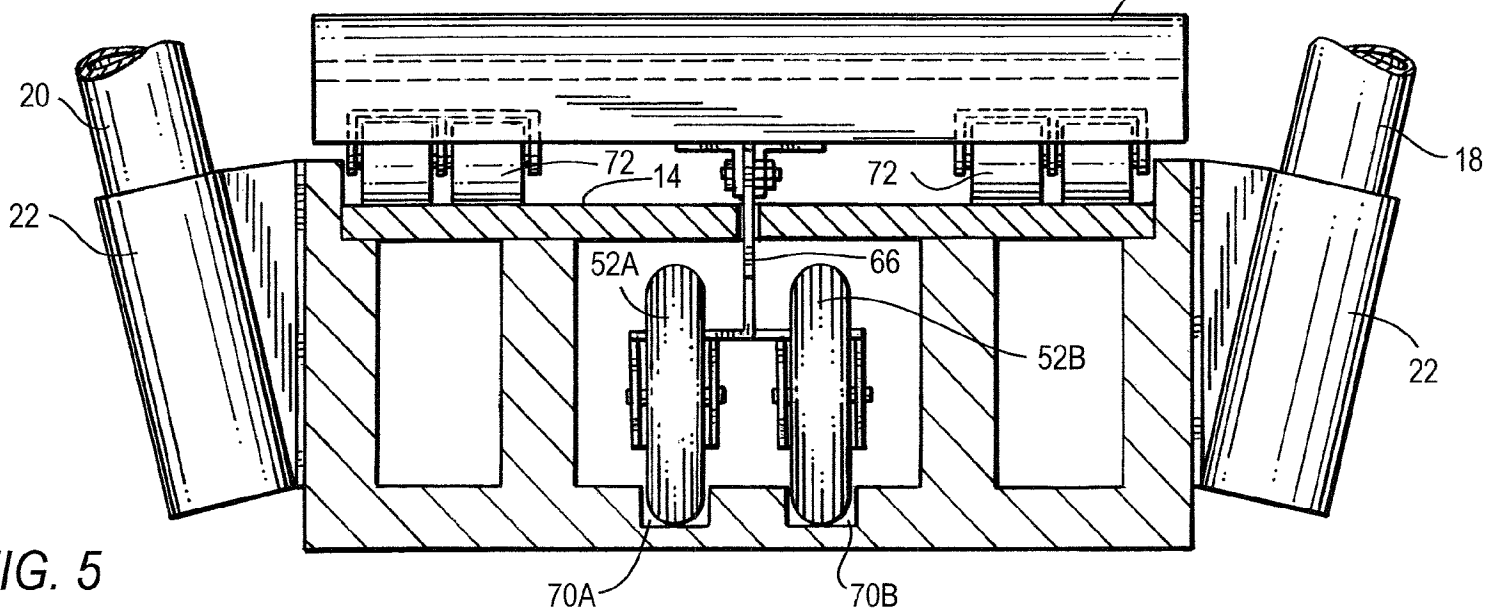
FIG. 5 shows a sectional view of the device taken along line 5-5 in FIG. 3.
Figure 9:
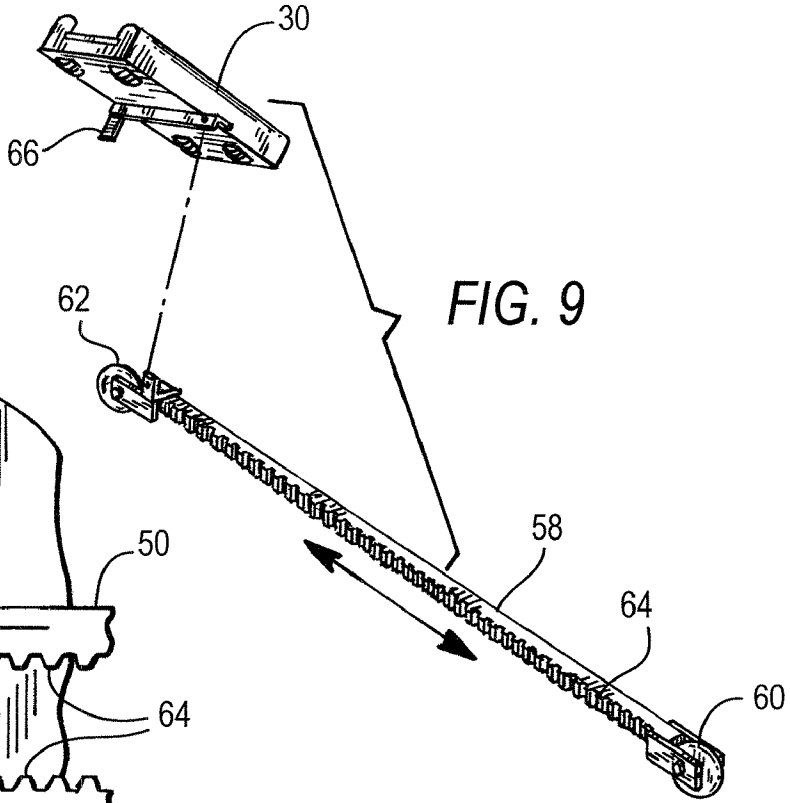
FIG. 9 shows an exploded view showing one of the carriages and its respective rack.
Figure 8:
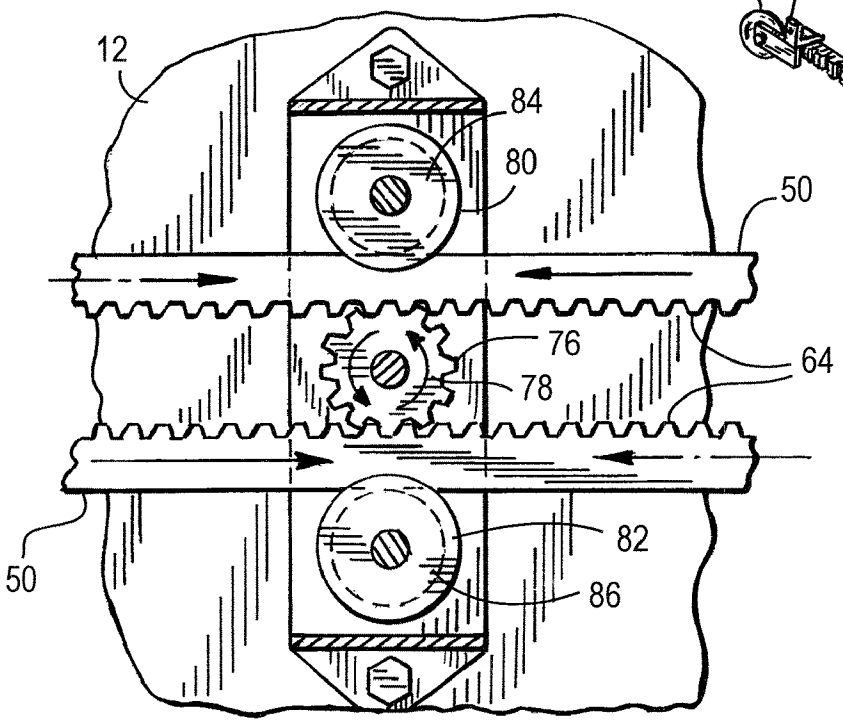
FIG. 8 is an enlarged top sectional view of the central portion of the device.

The bars 50, 58 have inner surfaces with vertical teeth as at 64. Each platform has a respective arm 66, 68 that extend down through the respective slot 24, 26. These arms are attached to the respective bars 50, 58. Thus the platforms 28, 30 can move back and forth longitudinally along the surface 14 and because of the arms, the bars 50, 58 similarly move back and forth inside the deck 12. The bars can be suspended within the deck or can slide on a bottom floor of the deck. However, preferably, they roll on their respective wheels 52, 54 or 60, 62. Moreover, for a smoother motion, each wheel can be formed of two discs riding in an appropriate trough. For example, as shown in FIG. 5, the wheel 52 can have two discs 52A, 52B riding in troughs 70A, 70B. Similarly, the platforms 30 are provided on their bottom with rollers 72 riding on top surface 14.

The pinion assembly 48 includes a central wheel or pinion 74 rotating about a vertical axis. The wheel 74 has a plurality of external vertical teeth 76 meshed with the teeth 64 of the two bars 50, 58.

The pinion assembly further includes two side wheels 80, 82 having respective cylindrical surfaces 84, 86, as shown. These surfaces act as bearings and engage the outer surfaces of the bars 50, 58 thereby insuring that teeth 76 and 64 remain meshed as the platforms move back and forth. In this manner, the rack and pinion mechanism provides an interlock for the movement of platforms 28 and 30.

Figure 12:
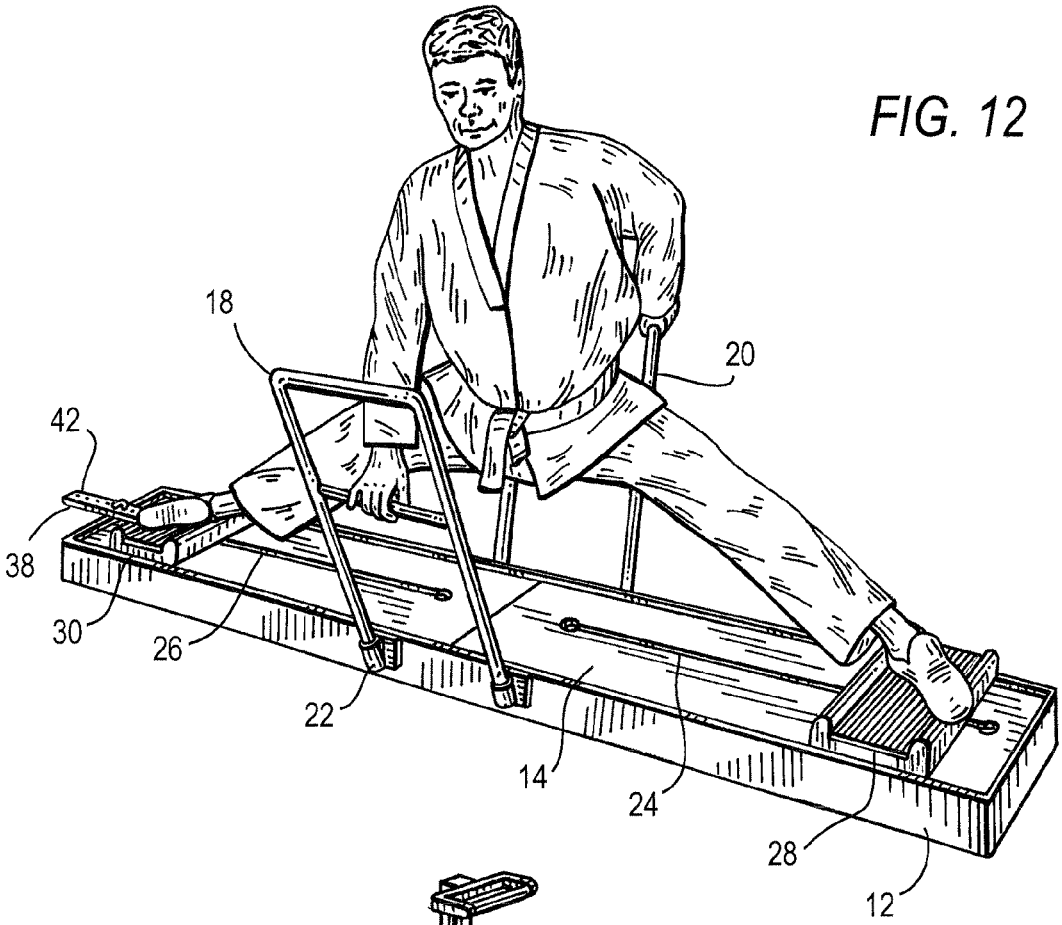
FIG. 12 shows a person using the subject device to perform a side split.
Figure 13:
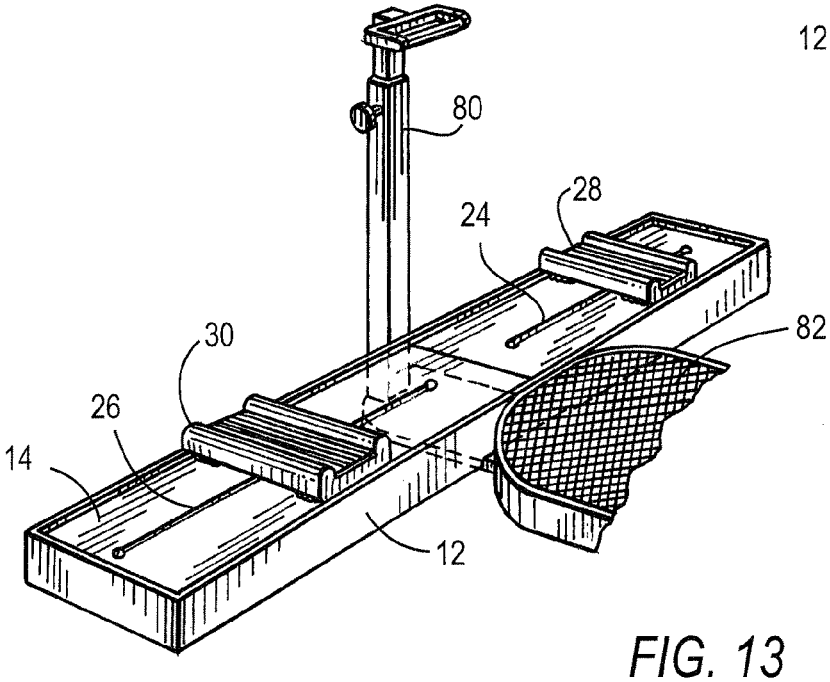
FIG. 13 shows a first alternate embodiment of the subject device for attachment to another apparatus.

FIGS. 10-12 show various exercises that can be performed on the device 10. In addition, with the handles 18, 20 removed, another handle 80 can be attached to one side of the deck 12 and used to perform other exercises together with another apparatus 82, as shown in FIG. 13.

FIGS. 14-18 shows an alternative embodiment of the invention. In this embodiment, handles 18, 20 are removed, and a footrest 90 is installed on the deck 12. In one embodiment, the footrest has a generally triangular shape as shown. The top surface 14 is provided with a plurality of holes that are angled and spaced longitudinally. The footrest 90 has a pin 94 extending downward and angled to fit into one of the holes 92. Thus the footrest can be placed into any one of several positions, such as position 90'.

The modified device further includes a hoop 96 attached to a side of platform 28, and a pulley 98 attached to the end of deck 12. A rope or cable 100 has one end attached to the hoop 96, passes around pulley 98 and terminates with a handle 102.

A person can perform exercises with only the modifications mentioned above. However, for more comfort, a seat 104 is provided that snaps onto, and covers the platform 30.

Figure 14:
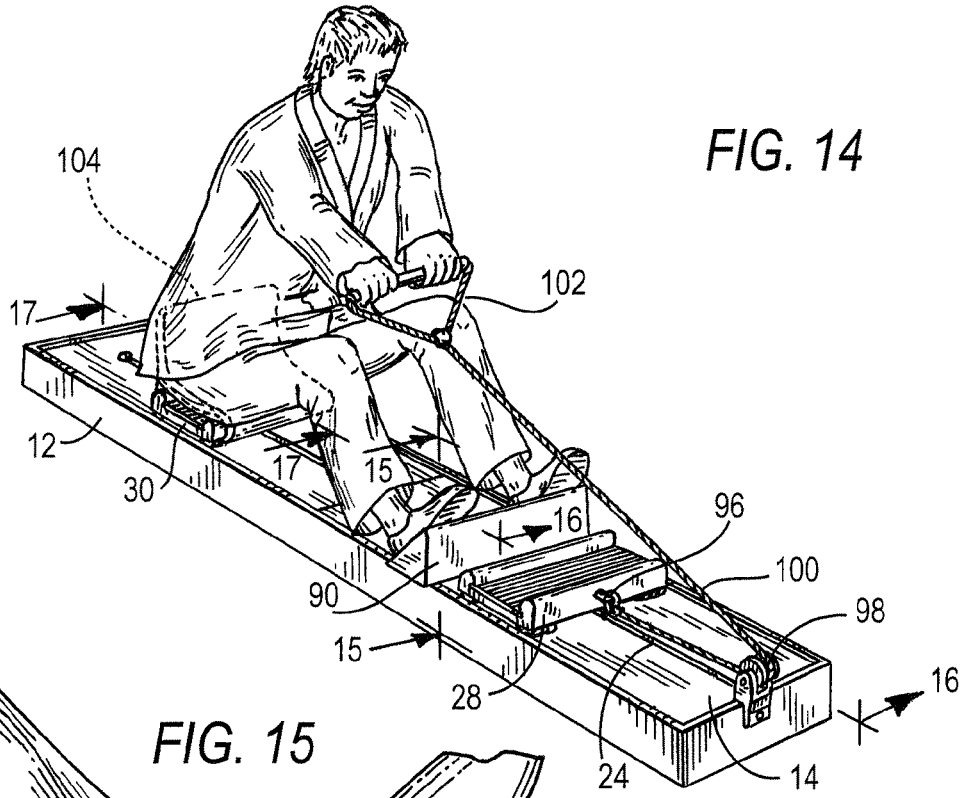
FIG. 14 a second alternate embodiment modified to allow a person to perform sit-ups on the device.
Figure 15:
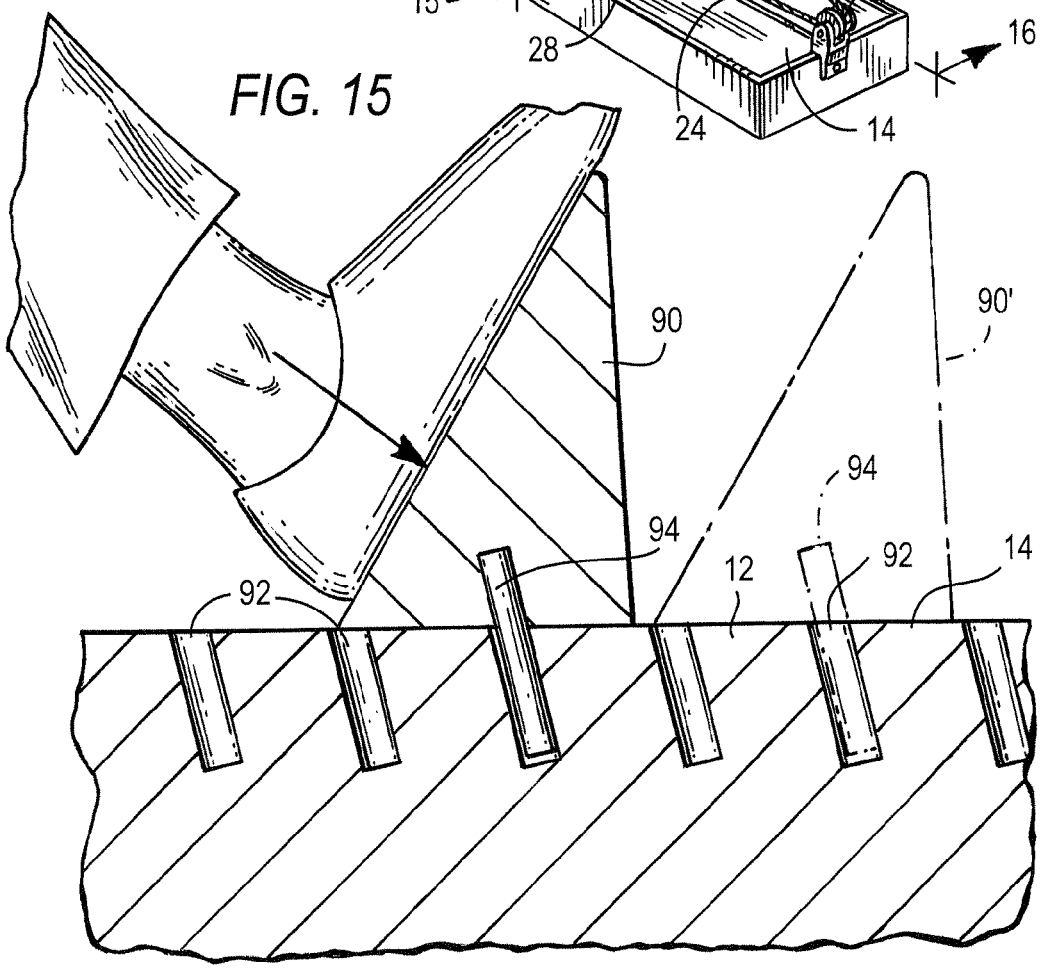
FIG. 15 shows details of the footrest for the embodiment of FIG. 14.
Figure 16:
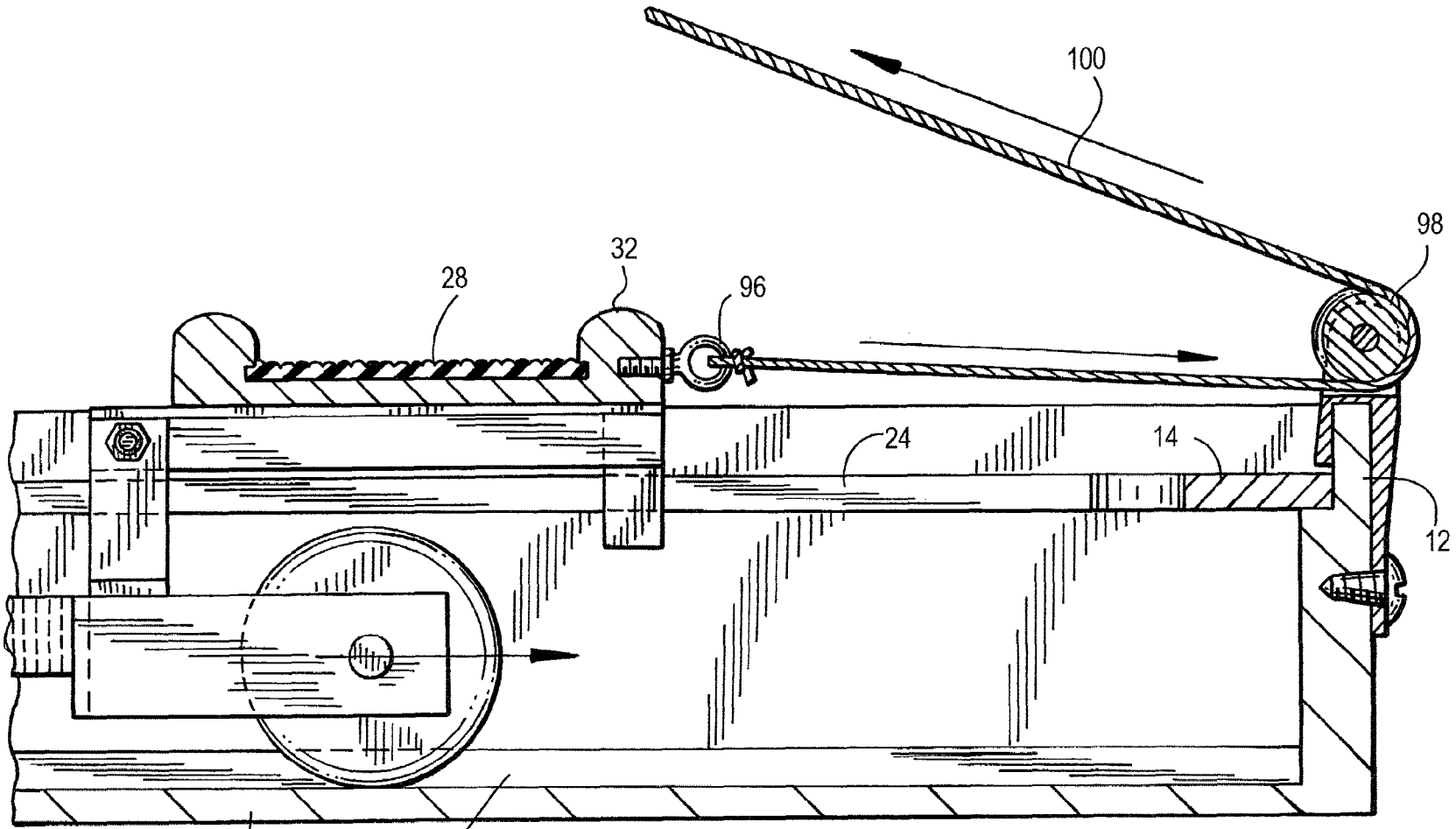
FIG. 16 shows details of an extra pulley used for the embodiment of FIG. 15.
Figure 17:
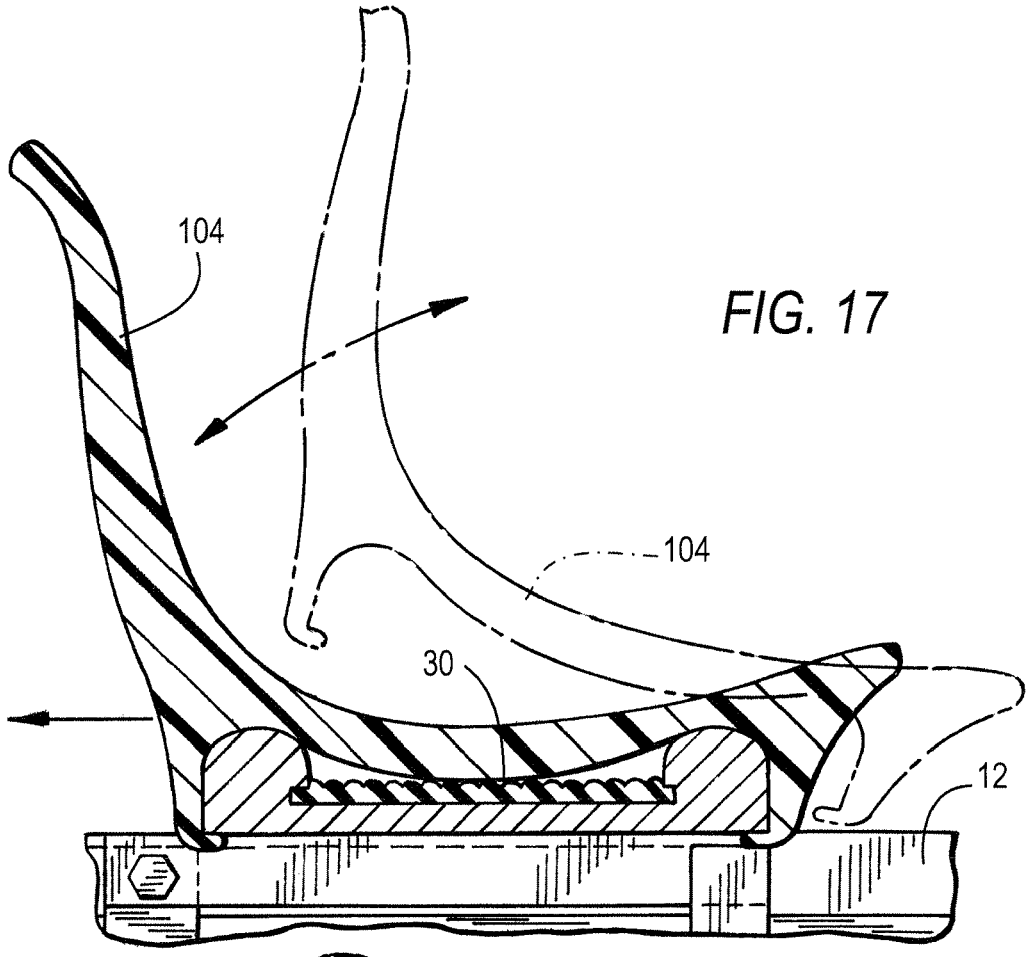
FIG. 17 shows details of the seat being attached.
Figure 18:
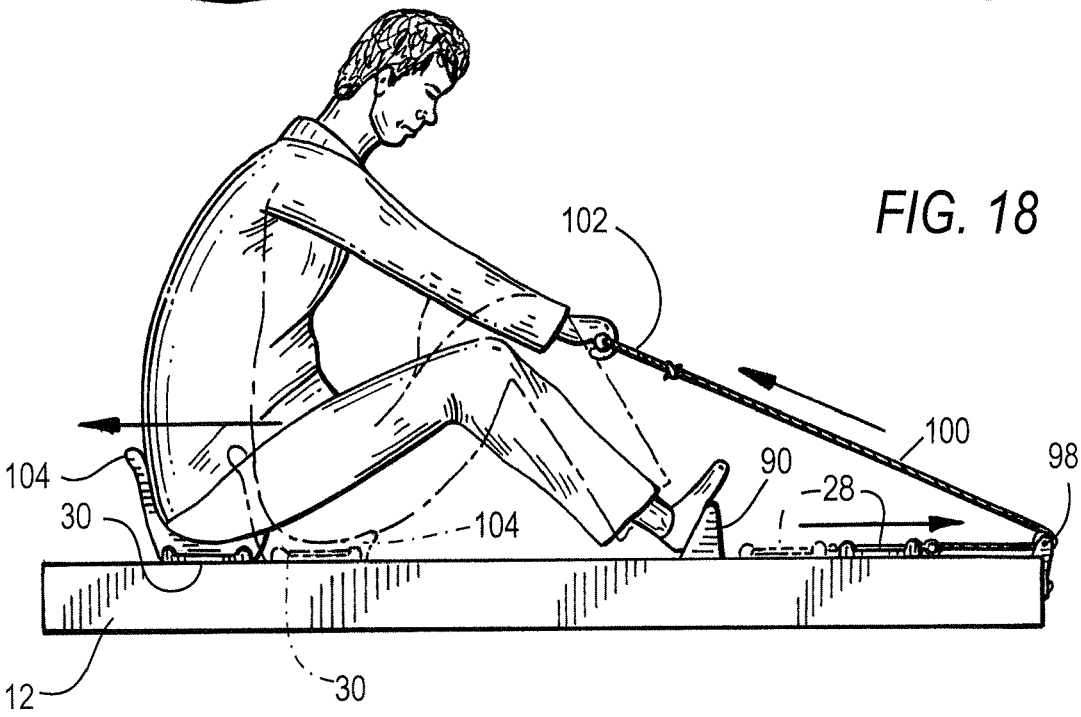
FIG. 18 shows a side view of a person doing an exercise for a lower backstretch using the device.

As a result of the modifications just described, a person can do exercises similar to sit-ups, as demonstrated in FIGS. 14 and 18.

Figure 19:
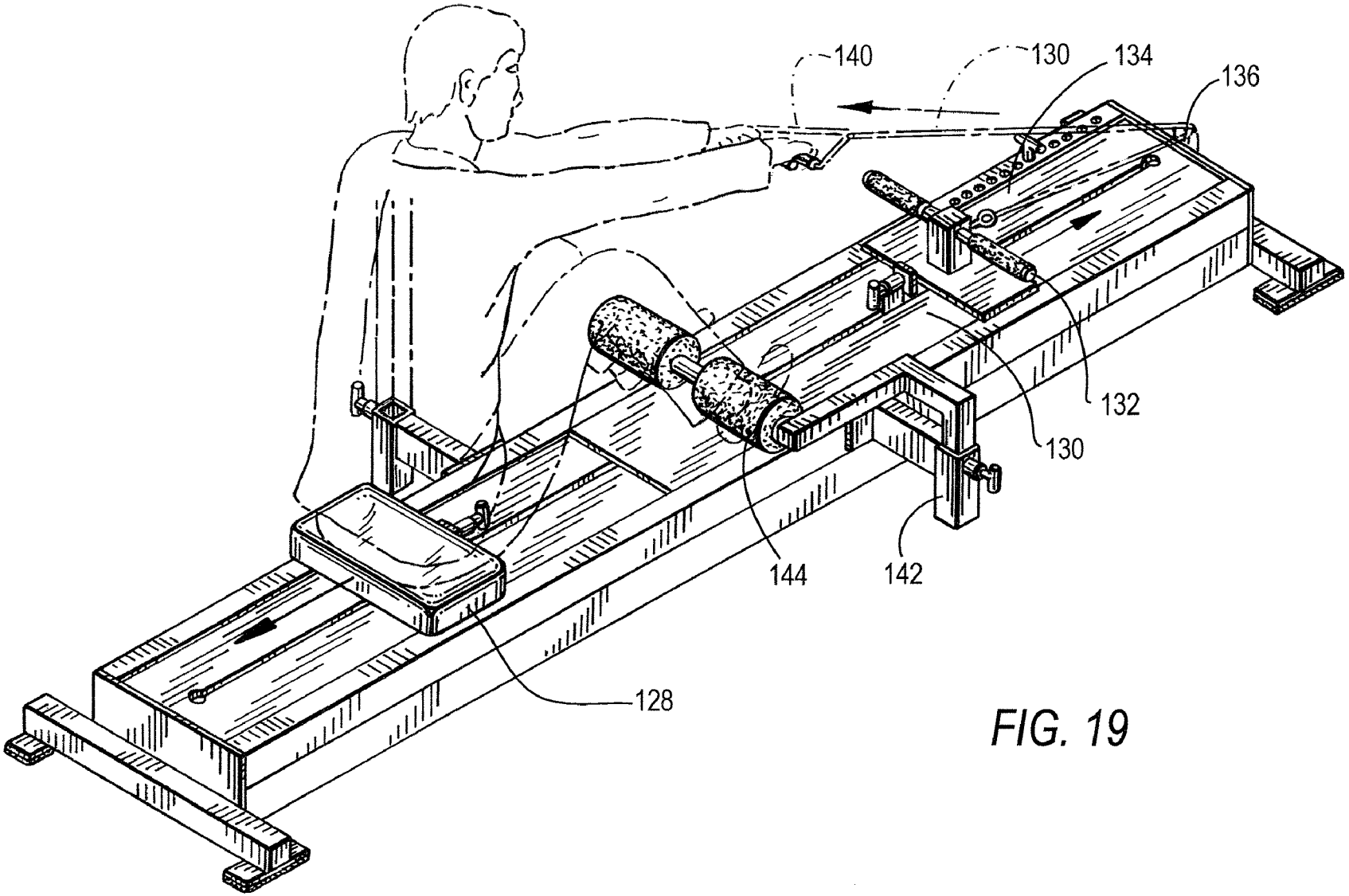
FIG. 19 shows a person exercising on a third alternate embodiment.
Figure 20:
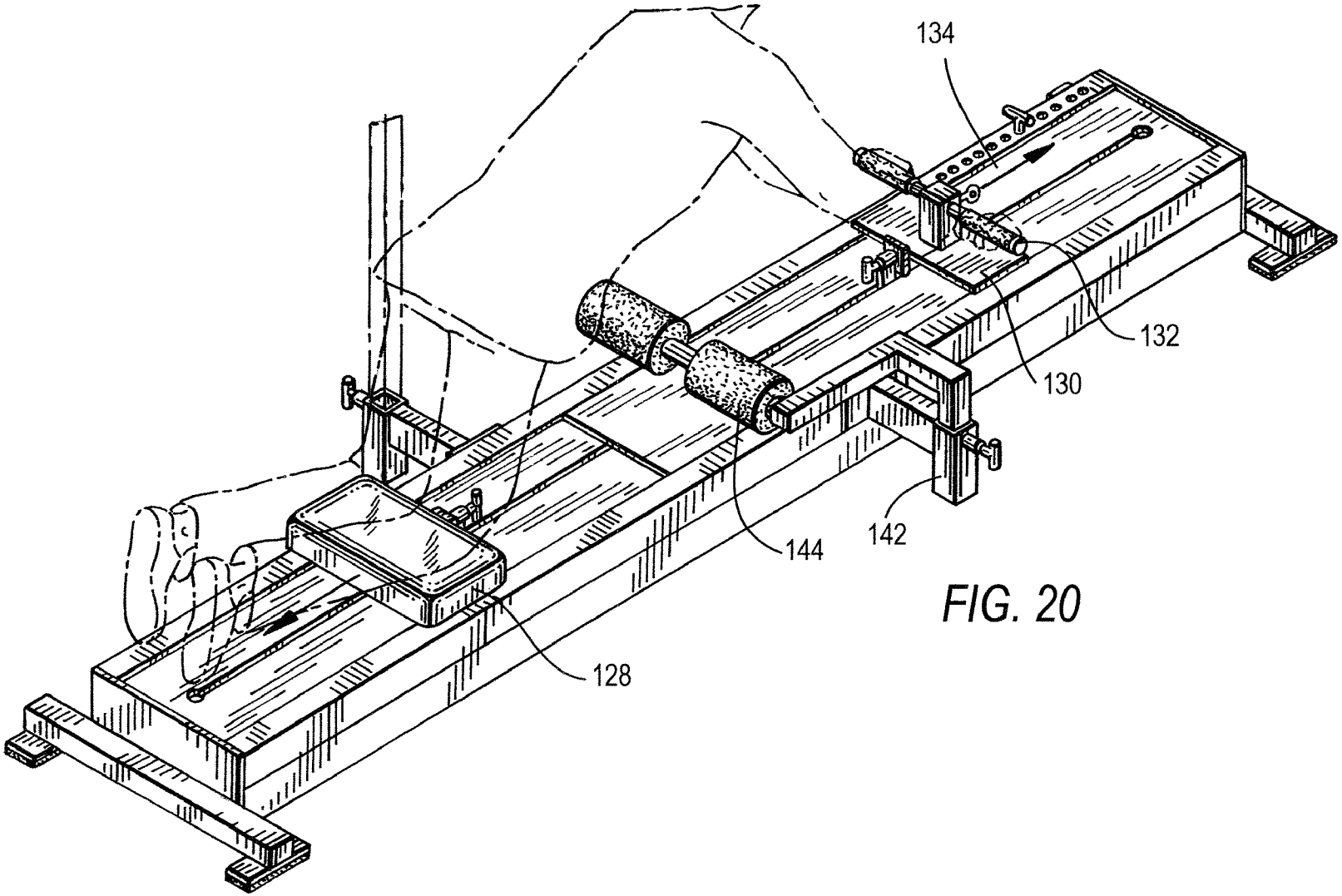
FIG. 20 shows a person doing another kind of exercise on the third alternate embodiment.

A slightly different set of modifications is shown in FIGS. 19 and 20. In these drawings, the platform 30 is covered with or replaced by a seat 128. In addition, the platform 28 is replaced with a plate 130 that is still attached to the bottom rack assembly. As a result, the seat 128 and the plate 130 move synchronously as described above.

The plate 130 has a first handle 132 and a hoop 134. The device further includes a pulley 136. Rope 138 is attached to hoop 134, passes around the pulley 136 and terminates with a second handle 140.

In addition, a base 142 is attached to the deck and supports some rollers 144. The modified apparatus is used to do rowing, lower backstretch or other types of exercises, as shown in FIGS. 19 and 20.

Numerous modifications may be made to this invention without departing from its scope as defined in the appended claims.

I claim:

1. An exercising apparatus comprising:

a deck having a top surface with a longitudinal axis comprising: a first and a second longitudinal slot disposed colinearly along the longitudinal axis;

a first and a second platform disposed on top of said first and said second longitudinal slot, sized and constructed to receive the feet of an exercising person, said platforms being movable along said longitudinal axis between respective first and second positions, wherein when said platforms are at said first respective positions, the person is standing with his feet together; and wherein when said platforms are at said respective second positions, the person is positioned with his feet spread apart and stretched laterally sideways;

a rack assembly coupled to said platforms to reciprocate said platforms in opposite directions simultaneously as they move along said longitudinal axis between said first and second positions, said rack assembly including a first and second elongated bar coupled to said first and second platforms, respectively, and a pinion assembly coupled between said bars.

2. The exercise apparatus of claim 1 wherein the first and second elongated bars are extending longitudinally under said deck, each of said elongated bars having respective first and second ends with guide wheels disposed at said ends for guiding said elongated bars.

3. The exercise apparatus of claim 2, wherein said deck includes first and second troughs and wherein said guide wheels ride in said troughs as said elongated bars are reciprocating.

4. The exercise apparatus of claim 1, further including vertical arms attached to said platforms and extending through said slots for coupling to said first and second elongated bars.

5. The exercise apparatus of claim 1, wherein the pinion assembly includes a central wheel that rotates about a vertical axis.

6. The exercise apparatus of claim 5, wherein said central wheel includes a plurality of external teeth disposed circumferentially about said central wheel, said elongated bars have teeth disposed at least on one side and wherein said external teeth are meshed with said elongated bar teeth.

7. The exercise apparatus of claim 6, wherein each elongated bars have an outer surface and said pinion assembly further includes a first and second side wheel, each side wheel having a cylindrical surface for engaging said outer surface of said first and second elongated bars for guiding said bars.

8. An exercising apparatus comprising:

a hollow deck including a top surface having a center and two longitudinal slots disposed colinearly and two opposed sides, said slots having first and second ends, said first ends being disposed near said center with said slots extending in opposite directions from said first ends to said second ends;

at least one handle bar attached to one of said sides;

first and second platforms disposed on top of the longitudinal slots and movable along said slots between respective first positions wherein said platforms are at said first ends of slot and second positions in which said platforms are at the respective second ends of slot; and a rack-and-pinion assembly disposed in said housing and coupled to said platforms, said rack-and-pinion assembly causing said platforms to reciprocate in opposite directions between said first and second positions.

9. The exercising apparatus of claim 8 further comprising vertical arms attached to said platforms and extending through said slots for coupling to said rack-and-pinion assembly.

10. The exercising apparatus of claim 9, further comprising a plate with a first handle arranged and constructed to replace said first platform, said plate attached to a vertical arm that extends through said longitudinal slots for coupling onto said rack-and-pinion assembly.

11. The exercising apparatus of claim 10 further comprising a hoop that is coupled to said plate and a pulley that is attached to one end of said deck, wherein a wire is coupled to said hoop, passes around said pulley, and terminates with a second handle.

12. The exercising apparatus of claim 11 in which said plate and said second platform are coupled to said rack-and-pinion assembly, wherein said plate reciprocate in opposite direction of said second platform simultaneously.

13. The exercise apparatus of claim 8, wherein said platforms include a first and second transversal ridge with a flat zone therebetween, said platforms being constructed to receive the feet of an exercising person.

14. The exercising apparatus of claim 13, wherein said second platform is covered by a seat with a back-supporting member, said seat includes a snapping member for snapping onto the traversal ridges of said second platform.

15. The exercise apparatus of claim 9, wherein said second platform is covered by a cushioned seat.

16. The exercise apparatus of claim 8, wherein said top surface includes a plurality of angled hole that are spaced longitudinally.

17. The exercise apparatus of claim 16, wherein a footrest includes a wall that is sufficiently angled to allow resting of a foot and a base with angled inserts that extends downwards for inserting into the plurality of angled holes.

18. The exercise machine of claim 13 wherein said rack-and-pinion assembly includes two elongated racks attached to said platforms and terminating in wheels and wherein said exercise machine includes a deck supporting said platform, and said racks resting on said deck and reciprocating along said deck on said wheels.

19. The exercise machine of claim 18 wherein said rack-pinion assembly includes a pinion with circumferentially positioned pinion teeth and said racks include a first lateral surface with rack teeth engaging said pinion teeth and a second lateral surface.

20. The exercise machine of claim 19 further including lateral wheels engaging said second lateral surfaces for guiding said racks as they move along said racks.

* * * * *